US008254816B2

(12) United States Patent
Mori

(10) Patent No.: US 8,254,816 B2
(45) Date of Patent: Aug. 28, 2012

(54) DEVELOPING DEVICE

(75) Inventor: Hiroki Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 361 days.

(21) Appl. No.: 12/644,368

(22) Filed: Dec. 22, 2009

(65) Prior Publication Data

US 2010/0158581 A1 Jun. 24, 2010

(30) Foreign Application Priority Data

Dec. 24, 2008 (JP) ..... 2008-327148

(51) Int. Cl.
*G03G 15/08* (2006.01)

(52) U.S. Cl. ..... 399/284

(58) Field of Classification Search ..... 399/274, 399/284, 272, 273, 283, 281
See application file for complete search history.

(56) References Cited

U.S. PATENT DOCUMENTS

| | | | | |
|---|---|---|---|---|
| 4,528,936 | A * | 7/1985 | Shimazaki et al. | 399/284 |
| 5,303,010 | A * | 4/1994 | Takano et al. | 399/284 |
| 5,853,868 | A * | 12/1998 | Bracken et al. | 399/284 |
| 6,212,343 | B1 | 4/2001 | Hosokawa et al. | |
| 7,058,349 | B2 * | 6/2006 | Kamimura | 399/274 |
| 2008/0050153 | A1 | 2/2008 | Mori et al. | |
| 2009/0169272 | A1 * | 7/2009 | Nishiyama et al. | 399/284 |

FOREIGN PATENT DOCUMENTS

| | | |
|---|---|---|
| JP | 2001-027844 | 1/2001 |
| JP | 2002-341644 | 11/2002 |
| JP | 2003-076140 A | 3/2003 |
| JP | 3825939 | 9/2006 |
| JP | 2008-051875 | 3/2008 |

OTHER PUBLICATIONS

CN First Office Action dated Sep. 15, 2011, corresponding Application No. 200910215380.X; English Translation.
The Decision of Rejection for Chinese patent application No. 200910215380.X mailed Apr. 26, 2012.

* cited by examiner

*Primary Examiner* — Susan Lee
(74) *Attorney, Agent, or Firm* — Banner & Witcoff, Ltd.

(57) ABSTRACT

The developing device includes a developing roller, a layer thickness regulating blade, a first supporting member, a second supporting member, and a securing member. The developing roller has a surface on which a developing agent is deposited. The layer thickness regulates blade that slidingly contacts the surface of the developing roller to regulate a thickness of the developing agent thereon. The first supporting member has a first pinching part and a first securing part oriented in different directions to have a first angle formed therebetween. The second supporting member having a second pinching part and a second securing part oriented in different directions to have a second angle formed therebetween, the second pinching part being urged against the first pinching part. The securing member secures the first securing part and the second securing part while pinching the layer thickness regulating blade between the first pinching part and the second pinching part.

8 Claims, 6 Drawing Sheets

DEVELOPING DEVICE

CROSS REFERENCE TO RELATED APPLICATION

This application claims priority from Japanese Patent Application No. 2008-327148 filed Dec. 24, 2008. The entire content of the priority application is incorporated herein by reference.

TECHNICAL FIELD

The invention relates to a developing device. More specifically, the invention relates to a layer thickness regulating blade that slidingly contacts with a developing roller to regulate thickness of developing agent deposited thereon.

BACKGROUND

In a conventional developing device, a layer-thickness regulating blade is fixed by a screw to a blade fixing section in a casing. In a holder for supporting the layer-thickness regulating blade, a surface for fixing the screw is the same as a surface for supporting the blade.

Recently, in order to downsize an image forming device, components of the image forming device such as a developing device and a layer thickness regulating blade are required to be downsized. However, such a conventional configuration of the layer thickness regulating blade increases the size of the developing device.

SUMMARY

In view of the foregoing, it is an object of the invention to provide a downsized developing device, and a layer thickness regulating blade which can be firmly fixed to a casing of the developing device.

In order to attain the above and other objects, the invention provides a developing device. The developing device includes a developing roller, a layer thickness regulating blade, a first supporting member, a second supporting member, and a securing member. The developing roller has a surface on which a developing agent is deposited. The layer thickness regulates blade that slidingly contacts the surface of the developing roller to regulate a thickness of the developing agent thereon. The first supporting member has a first pinching part and a first securing part oriented in different directions to have a first angle formed therebetween. The second supporting member having a second pinching part and a second securing part oriented in different directions to have a second angle formed therebetween, the second pinching part being urged against the first pinching part. The securing member secures the first securing part and the second securing part while pinching the layer thickness regulating blade between the first pinching part and the second pinching part.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
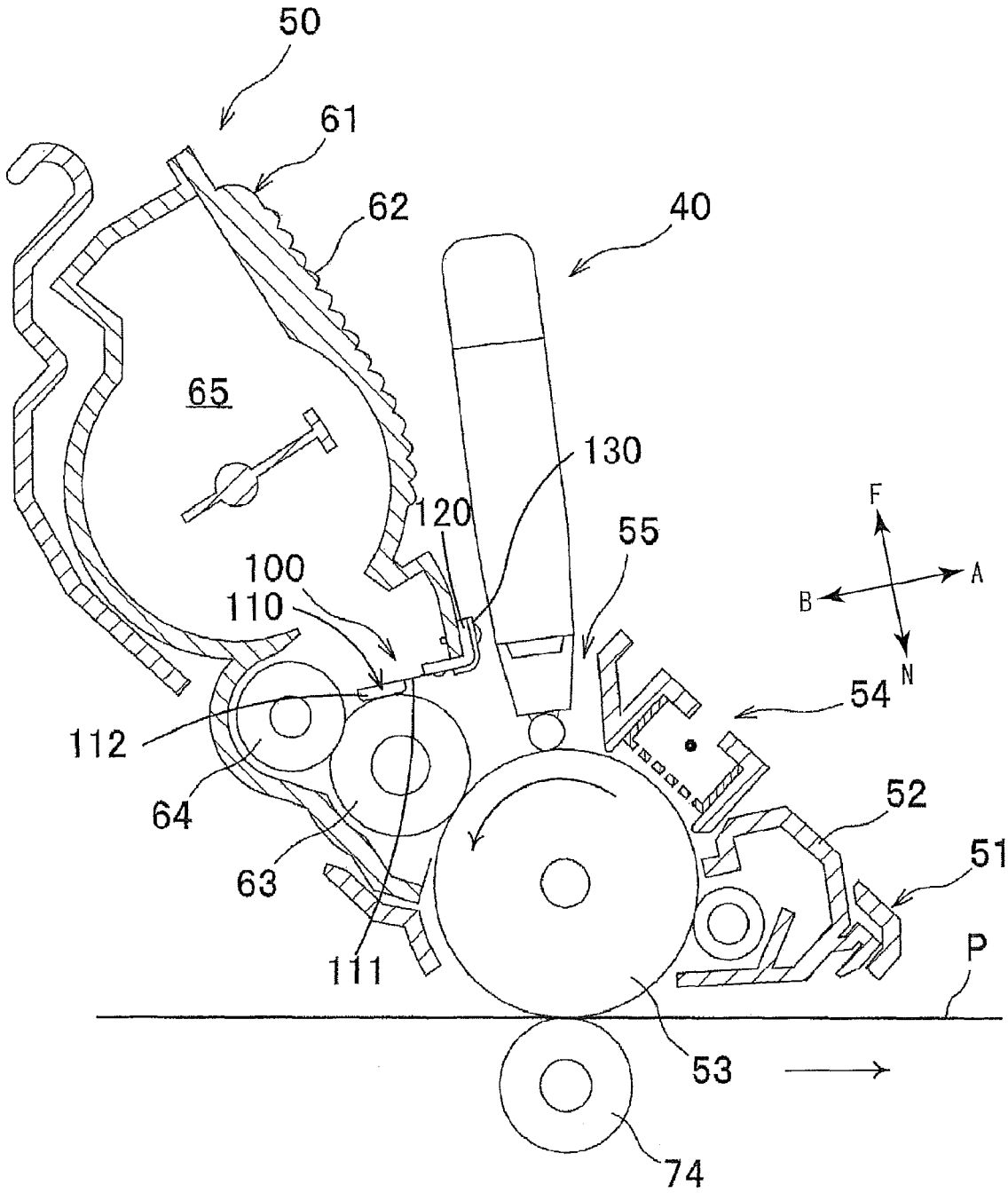
FIG. 1 is a cross-sectional view of a process cartridge and a LED unit according to an embodiment of the invention.

A process cartridge 50 and an LED unit 40 mounted in a color printer (not shown) according to an embodiment of the invention will be described while referring to the accompanying drawings.

The process cartridge 50 includes a drum unit 51 and a developing unit 61 as an example of a developing device. The developing unit 61 is detachably mounted in the drum unit 51. In the color printer, a plurality of the process cartridges 50 is mounted.

The drum unit 51 mainly includes a drum casing 52, a photosensitive drum 53 rotatably supported to the drum casing 52, and a charger 54. An opening 55 is formed in the drum casing 52. Even after the developing unit 61 is mounted in the drum unit 51, the photosensitive drum 53 can be seen externally through the opening 55. The LED unit 40 is inserted through the opening 55 toward the photosensitive drum 53 so as to be in confrontation with the photosensitive drum 53 from above.

The LED unit 40 has a light emitting portion located at lower end thereof. Light emitted from the light emitting portion exposes a surface of the photosensitive drum 53. The LED unit 40 is fixed to an upper cover (not shown) of the color printer. The upper cover (not shown) is pivotally movable upward. Upon pivotal and upward movement of the upper cover (not shown), the LED unit 40 is movable away from the photosensitive drum 53.

The developing unit 61 includes a developing casing 62, a developing roller 63, a supply roller 64, a blade unit 100, and a toner chamber 65. The developing roller 63 and the supply roller 64 are rotatably supported to the developing casing 62. The toner chamber 65 retains toner as a developing agent therein.

A transfer roller 74 is disposed opposing the photosensitive drum 53. A transfer bias is applied to the transfer roller 74 by constant current control when transferring a toner image onto a sheet P.

With the process cartridge 50 having the above configuration, the surface of the photosensitive drum 53 is uniformly charged by the charger 54. Irradiating the charged surface of the photosensitive drum 53 with the light emitted from the LED unit 40 lowers potential in the exposed area, thereby forming an electrostatic latent image on the photosensitive drum 53 based on image data. The toner retained in the toner chamber 65 is supplied to the developing roller 63 in association with rotation of the supply roller 64. The toner supplied to the developing roller 63 is conveyed between the blade unit 100 and the developing roller 63 in association with rotation of the developing roller 63. The toner is deposited on the developing roller 63 to form a layer thereon having a given thickness.

Since the developing roller 63 faces and contacts the photosensitive drum 53, the toner deposited on the developing roller 63 is supplied to the electrostatic latent image formed on the photosensitive drum 53. The toner is selectively deposited on the photosensitive drum 53, so that a visible toner image corresponding to the electrostatic latent image is formed by a reversal development. Since the sheet P passes between the photosensitive drum 53 and the transfer roller 74, the toner image formed on the photosensitive drum 53 is transferred onto the sheet P.

Next, the blade unit 100 will be described in detail while referring to FIGS. 2 to 6.

Figure 2:
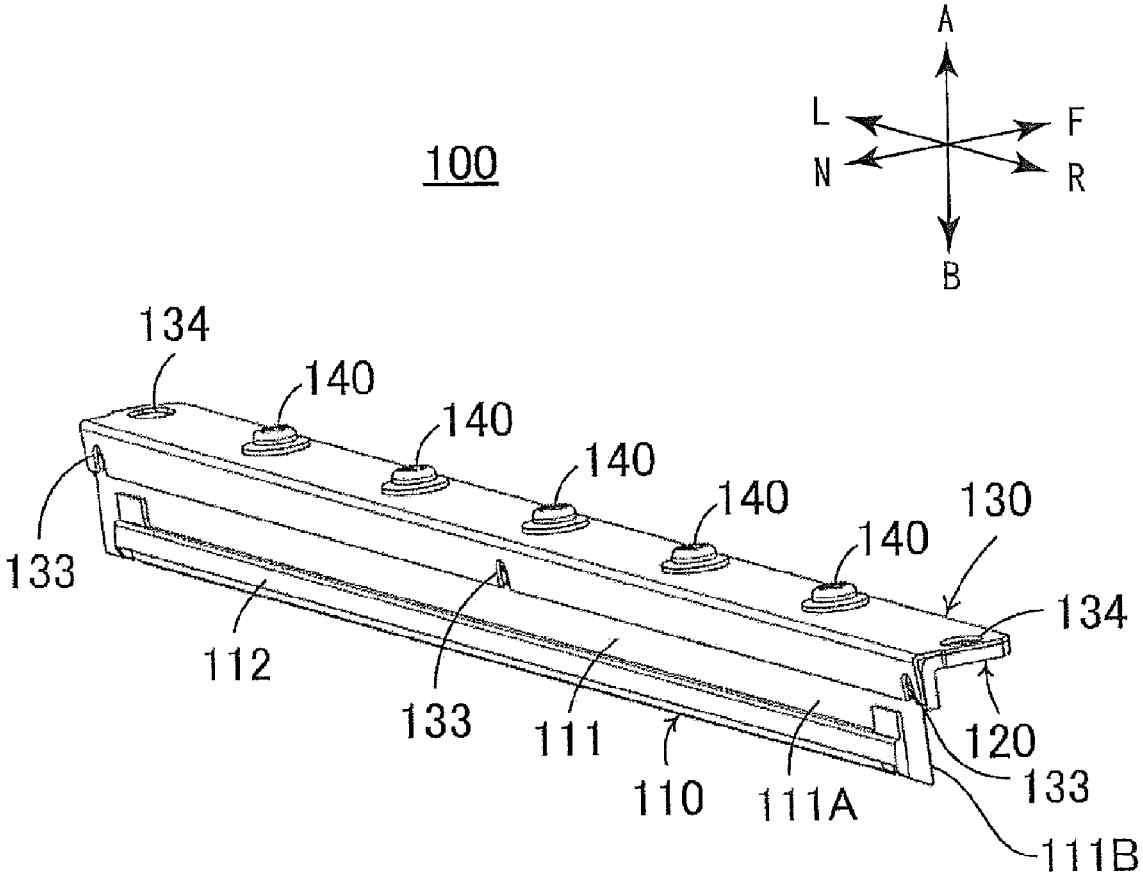
FIG. 2 is a perspective view of a blade unit according to the embodiment.

In the description referring to FIGS. 2 to 6, directions A, N, L are respectively opposite to directions B, F, R. The directions A, N, L are at right angles to each other. The directions A, B, N, F, L, R will be used assuming that the blade unit 100 is disposed in an orientation as shown in FIG. 2. The directions L, R are parallel to the axial direction of the developing roller 63.

Figure 3:
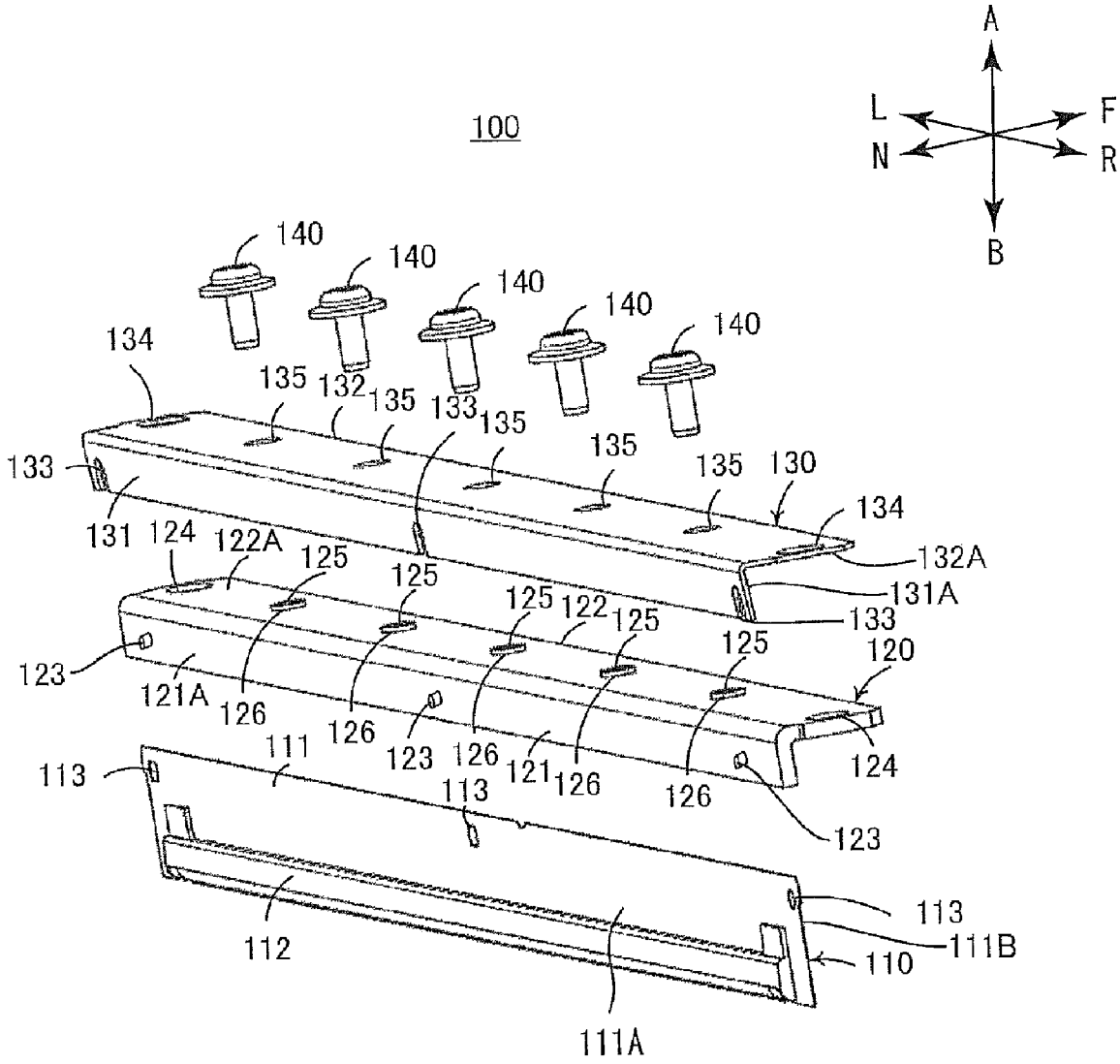
FIG. 3 is an exploded perspective view of the blade unit according to the embodiment.
Figure 4:
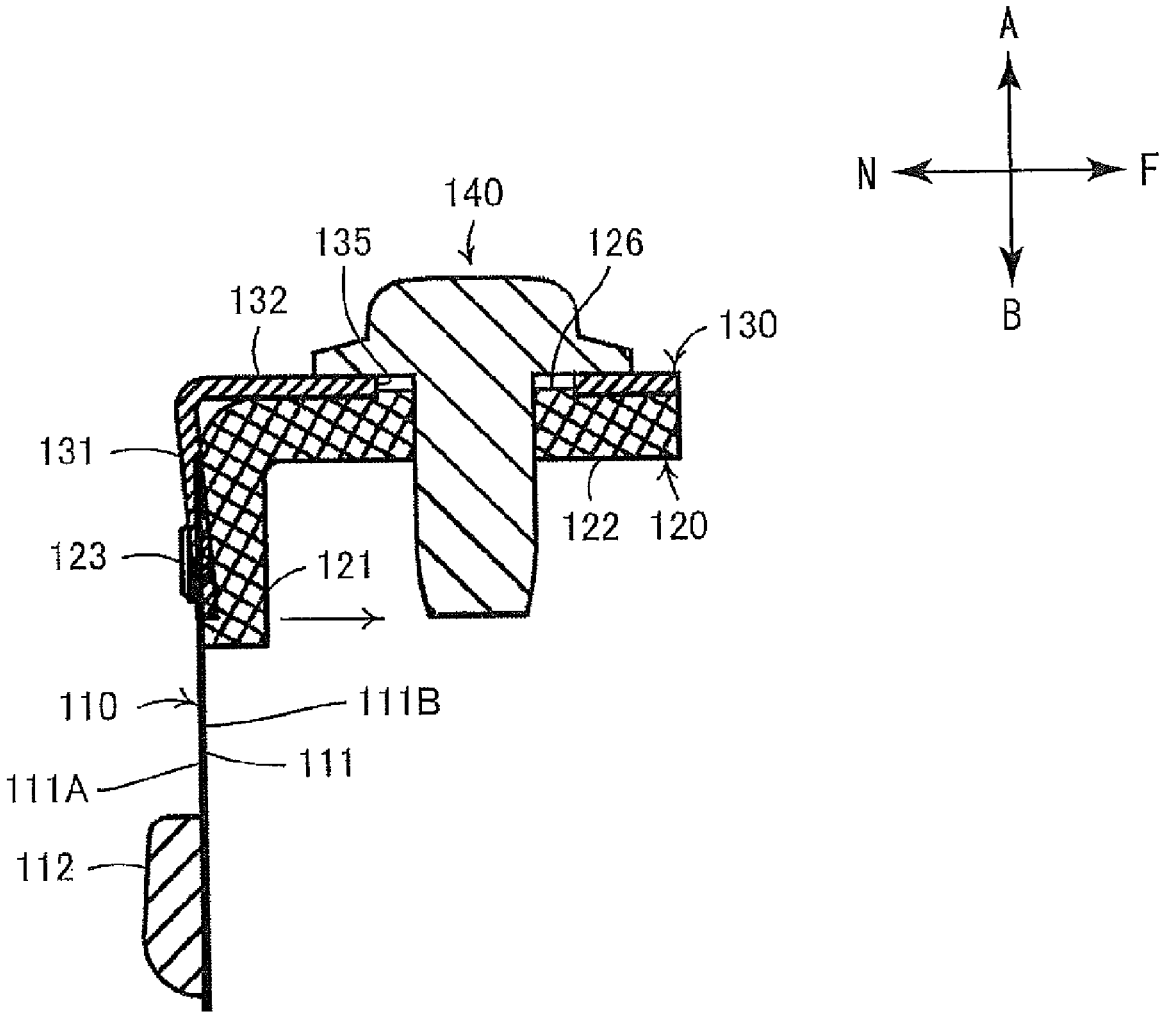
FIG. 4 is a cross-sectional view of the blade unit according to the embodiment.

As shown in FIGS. 2 and 3, the blade unit 100 includes a layer thickness regulating blade 110 (hereinafter referred to simply as "blade 110"), a blade holder 120 as a first supporting member, a blade reinforcing plate 130 as a second supporting member, and a screw 140 as a securing member.

As shown in FIG. 2, the blade 110 is disposed between the blade holder 120 and the blade reinforcing plate 130. As shown in FIG. 1, the blade holder 120 is in contact with the developing casing 62. The blade reinforcing plate 130 is not in direct contact with the developing casing 62. In other words, the blade holder 120 is interposed between the developing casing 62 and the blade reinforcing plate 130.

As shown in FIG. 3, the blade 110 includes a plate-like member 111 and a pressing member 112.

The plate-like member 111 is a thin metal plate formed in a rectangular shape. The plate-like member 111 has resiliency so as to generate an urging force against the developing roller 63.

As shown in FIG. 2, the plate-like member 111 has a first surface 111A and a second surface 111B. The first and second surfaces 111A, 111B extends in the direction A and the direction L.

An upstream end portion of the plate-like member 111 in the direction B is formed with a plurality of positioning holes 113 (three in this embodiment). The positioning holes 113 are formed in a central portion and each end portion of the plate-like member 111 in a longitudinal direction of the plate-like member 111 (that is, an axial direction of the developing roller 63).

The pressing member 112 is provided at a downstream end portion of the first surface 111A in the direction B. The pressing member 112 is formed of rubber. The pressing member 112 has a convex shape in cross section protruding toward the developing roller 63 (see FIG. 1). The pressing member 112 is directly brought into sliding contact with the developing roller 63 so as to regulate the thickness of the toner deposited on the surface of the developing roller 63.

As shown in FIG. 3, the blade holder 120 is a plate-like member formed of metal. The blade holder 120 is bent so as to form a substantially L-shape. The blade holder 120 has a pinching section 121 extending in the directions A, L and an attaching section 122 extending in the directions N, L.

The pinching section 121 pinches the plate-like member 111 with a pinching section 131 of the blade reinforcing plate 130. The pinching section 121 has a pinching outer surface 121A. The pinching outer surface 121A is in contact with the second surface 111B.

The pinching outer surface 121A has a plurality of protruding portions 123 (three in this embodiment). The protruding portions 123 are provided at a central portion and each end portion of the pinching outer surface 121A in the axial direction. Since each of the protruding portions 123 is provided at a position superposed with each of the positioning holes 113, the protruding portion 123 is fitted in the positioning hole 113.

The attaching section 122 has a fixing outer surface 122A. As shown in FIG. 3, the fixing outer surface 122A faces the blade reinforcing plate 130. The attaching section 122 is fixed to the developing casing 62.

In this embodiment, an angle $\alpha$ between the pinching outer surface 121A and the fixing outer surface 122A is 90 degrees. Further, a thickness t1 of the blade holder 120 is 1.6 mm (see FIG. 5).

Each end portion of the attaching section 122 in the axial direction is formed with a through-hole 124 allowing a screw to be inserted therein so as to fix the attaching section 122 to the developing casing 62. The attaching section 122 is also formed with a plurality of screw through-holes 125 (five in this embodiment) as a first hole in which screws for fixing the blade reinforcing plate 130 to the blade holder 120 are inserted. The screw through-holes 125 are positioned between a pair of the through-holes 124. The through-holes 124 and the screw through-holes 125 are disposed substantially at an equi-pitch in the axial direction.

A cylindrical boss portion 126 protrudes from a peripheral edge of the screw through-hole 125. That is, the cylindrical boss portion 126 surrounds the throughhole 125. The protruding height of the cylindrical boss portion 126 from the peripheral edge is defined as H1 (see FIG. 5). In other words, the boss extends from the fixing outer surface 122A. The height H1 is a length from the fixing outer surface 122A to the upstream end of the cylindrical boss portion 126 in the direction A. The cylindrical boss portion 126 has an outer peripheral surface 115.

The screw through-hole 125 may be a threaded screw hole of which an inner peripheral surface is formed with a groove. The screw through-hole 125 may be a hole having an inner cylindrical surface which is grooved by a screw when the screw is inserted in the through-hole. The hole 125 may not pass-through the attaching section 122. In this case, the hole 125 is formed from the fixing outer surface 122.

As shown in FIG. 3, the blade reinforcing plate 130 is a plate-like member formed of metal. The blade reinforcing plate 130 is bent so as to form a substantially L-shape. The blade reinforcing plate 130 has the pinching section 131 extending in the directions A, L and an attaching section 132 extending in the directions N, L. The attaching section 132 is disposed in confrontation with the attaching section 122, and fixed to the developing casing 62 in combination with the attaching section 122.

The pinching section 131 pinches the plate-like member 111 with the pinching section 121. The pinching section 131 has a pinching inner surface 131A. The pinching inner surface 131A is in confrontation with the pinching outer surface 121A. The pinching inner surface 131A is in confrontation with and in contact with the first surface 111A. The pinching inner surface 131A has an end portion 136 at the downstream end thereof in the direction B (see FIG. 6). Further, the pinching section 131 is formed with a plurality of substantially semicircular cutout portions 133 at the downstream end thereof in the direction B. The cutout portions 133 (three in this embodiment) is formed in a central portion and each end portion of the pinching section 131 in the axial direction of the developing roller 63. The cutout portion 133 prevents the pinching section 131 from impinging against the protruding portion 123.

Figure 6:
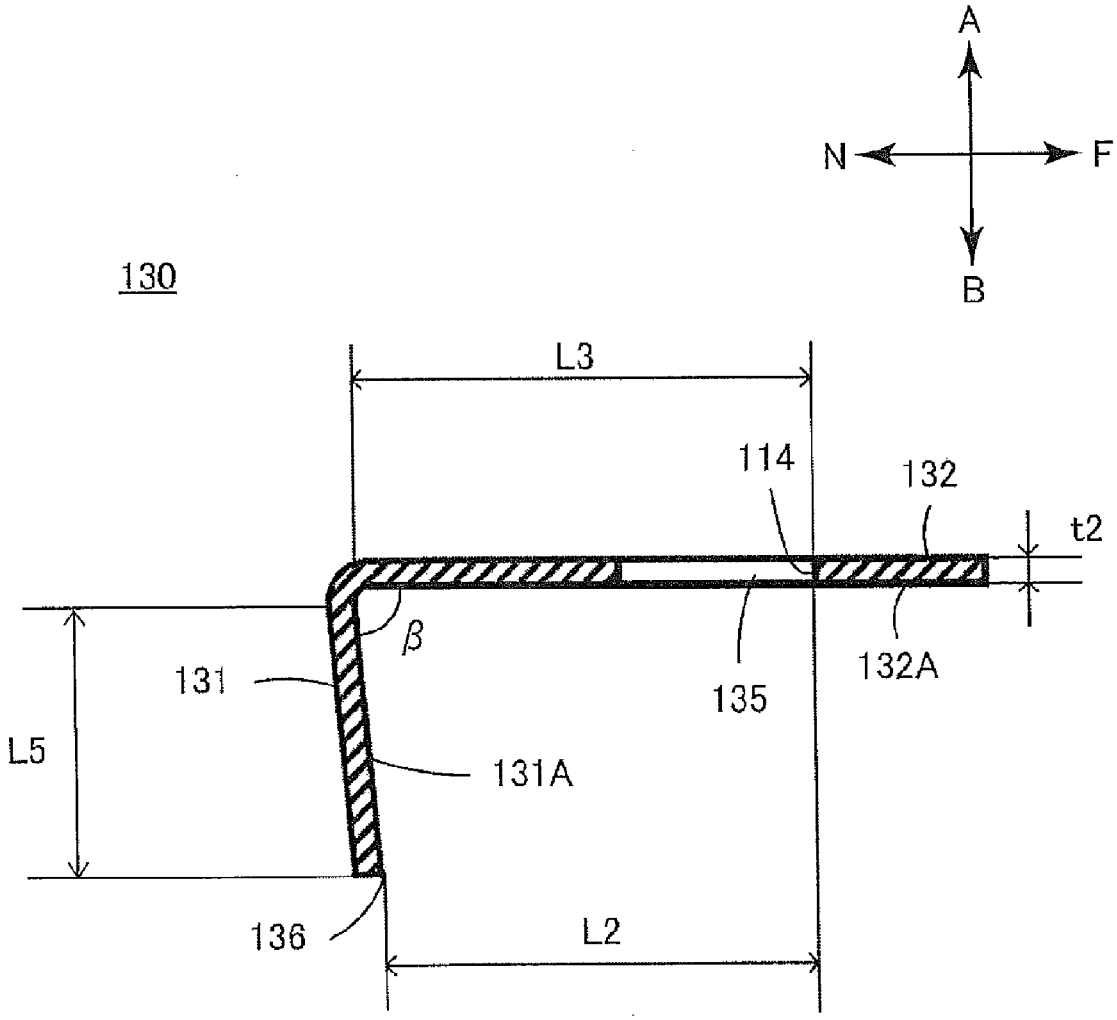
FIG. 6 is a cross-sectional view of a blade reinforcing plate according to the embodiment.

The attaching section 132 has a fixing inner surface 132A. The fixing inner surface 132A is in confrontation and in contact with the fixing outer surface 122A. In this embodiment, as shown in FIG. 6, an angle β between the pinching inner surface 131A and the fixing inner surface 132A is 85 degrees. The angle β is arranged to be smaller than the angle α. Further, a thickness t2 of the blade reinforcing plate 130 is 0.5 mm. The thickness t2 is arranged to be smaller than the thickness t1.

The attaching section 132 is formed with a pair of through-holes 134 at a position superposed with a pair of the through-holes 124. The through-hole 124 and the through-hole 134 are respectively formed in an elliptical shape of which a major axis extends in a direction perpendicular to the axial direction. The screw through-hole 135 has an inner peripheral surface 114. The attaching section 132 is also formed with a plurality of screw holes 135 (five in this embodiment) at a position superposed with the screw through-holes 125. The cylindrical boss portion 126 has a shape and a size to be inserted into the screw hole 135. Thus, the cylindrical boss portion 126 is fitted in the screw hole 135 (see FIG. 4). An outer peripheral surface 115 (FIG. 5) of the cylindrical boss portion 126 is in contact with the inner peripheral surface 114 (FIG. 6) of the screw holes 135 when the cylindrical boss portion 126 is fitted in the screw holes 135. The protruding height H1 is arranged to be shorter than the depth of the screw hole 135, that is, the thickness t2 (see FIGS. 4-6). The screws 140 secure the attaching section 122 and attaching section 132 while pinching the blade 110 between the pinching section 121 and the pinching section 131.

When assembling the blade holder 120 and the blade reinforcing plate 130, a downstream part of the inner peripheral surface 114 in the direction B contacts the outer peripheral surface 115. Accordingly, a relative movement between the blade holder 120 and the blade reinforcing plate 130 is prevented.

Figure 5:
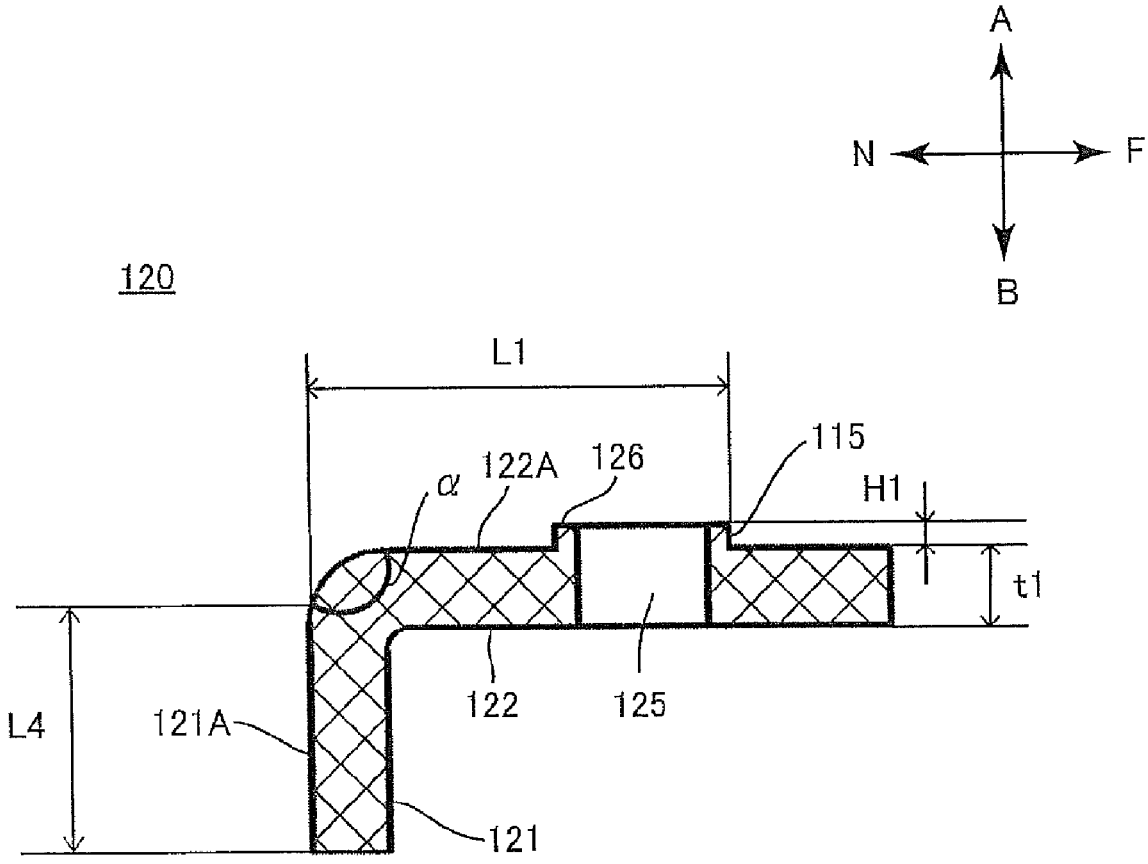
FIG. 5 is a cross-sectional view of a blade holder according to the embodiment.

As shown in FIG. 5, a length L1 is defined as a length from the pinching outer surface 121A to an upstream end portion of the outer peripheral surface 115 in the direction N. As shown in FIG. 6, a length L2 is defined as a length from the downstream end portion 136 to a vertical line passing and parallel to an upstream end portion of the inner peripheral surface 114 in the direction N is defined as L2. The length L2 is shorter than the length L1 (see FIGS. 5 and 6) before assembling the blade holder 120 and the blade reinforcing plate 130. A length from a downstream end of the pinching inner surface 131A in the direction N to a vertical line passing and parallel to an upstream end portion of the inner peripheral surface 114 in the direction N is defined as L3. The length L3 is longer than the length L1.

As shown in FIG. 5, a length L4 is defined as a length of the pinching outer surface 121A in the direction A. As shown in FIG. 6, a length L5 is defined as a length of the pinching inner surface 131A in the direction A. The length L4 is longer than the length L5.

Next, assembly of the blade unit 100 will be described. The blade holder 120 is fixed to a well-known jig. The protruding portion 123 is inserted into the positioning hole 113, thereby mounting the blade 110 in the blade holder 120. The blade reinforcing plate 130 is positioned over the blade holder 120. The cutout portion 133 is engaged with the protruding portion 123 protruding from the positioning hole 113. In this state, by using another jig, the blade reinforcing plate 130 is pressed against the blade holder 120 so that the angle β between the pinching inner surface 131A and the fixing inner surface 132A is broadened. By resilient deformation of the reinforcing plate 130, the pinching section 131 fits with the blade holder 120. The cylindrical boss portion 126 is inserted into the screw hole 135 to have the attaching section 122 and the attaching section 132 secured and to position the pinching section 121 and the pinching section 131 such that the blade 110 is pinched therebetween.

The blade reinforcing plate 130 is fixed to the blade holder 120 by the screws 140. The screw 140 is inserted into the screw through-holes 125, 135 from the blade reinforcing plate 130 toward the blade holder 120. Since the blade reinforcing plate 130 is resiliently deformed, a restoring force of the blade reinforcing plate 130 is generated in a direction indicated by an arrow shown in FIG. 4. The pinching inner surface 131A presses the pinching outer surface 121A, so that a pinching force between the pinching inner surface 131A and the pinching outer surface 121A acts on the blade 110.

Compared to a conceivable case where the blade 110 is pinched by supporting members that is parallel to the blade 110, the pinching force according to the embodiment acting on the blade 110 can be strengthened. Thus, the blade 110 can be firmly pinched between the blade holder 120 and the blade reinforcing plate 130.

Further, the thickness t2 of the blade reinforcing plate 130 is smaller than the thickness t1 of the blade holder 120. The blade reinforcing plate 130 is easily resiliently deformable. The blade reinforcing plate 130 easily fits with the blade holder 120. Accordingly, the pinching force effectively acts on the blade 110.

Further, the height H1 is arranged to be shorter than the depth of the screw hole 135 (the thickness t2). A clamping force of the screw 140 when assembling does not directly act on the cylindrical boss portion 126. The clamping force only affects a peripheral edge of the screw hole 135. Accordingly, the blade holder 120 and the blade reinforcing plate 130 are firmly fixed by the screws 140.

Subsequently, the blade unit 100 is fixed to the developing casing 62 by the screws through the through-holes 124 and the through-holes 134, as shown in FIG. 1. The blade unit 100 is disposed in the developing unit 61 such that the pressing member 112 is brought into contact with the developing roller 63. When an image is formed, the toner supplied to the developing roller 63 from the supply roller 64 is regulated its thickness between the developing roller 63 and the pressing member 112 in association with rotation of the developing roller 63. The toner is thus deposited on the developing roller 63 with a given thickness.

The pinching outer surface 121A extends in a direction different from a direction in which the fixing outer surface 122A and the fixing inner surface 132A extend. Further, the pinching inner surface 131A extends in a direction different from the direction in which the fixing outer surface 122A and the fixing inner surface 132A extend. Compared to a conceivable case where screw holes are formed in the same surface on which the screws up, the size of the pinching outer surface 121A and the pinching inner surface 131A in a direction to which each of the surfaces extends can be reduced. Accordingly, the developing unit 61 can be downsized as a whole. Besides, the color printer in which the developing unit 61 is mounted can also be downsized.

While the invention has been described in detail with reference to the embodiment thereof, it would be apparent to those skilled in the art that various changes and modifications may be made therein without departing from the spirit of the invention.

In the above embodiment, the developing unit 61 as a developing device includes the developing roller 63, the supply roller 64, the blade unit 100, and the toner chamber 65. However, a developing device without the toner chamber (that is, a developing device in which a developer cartridge is detachably mounted) is also applicable. Further, a developing device having the photosensitive drum and the charger in addition to the above components is also applicable.

What is claimed is:

1. A developing device comprising:

a developing roller having a surface on which a developing agent is deposited;

a layer thickness regulating blade that slidingly contacts the surface of the developing roller to regulate a thickness of the developing agent thereon;

a first supporting member having a first pinching part and a first securing part oriented in different directions to have a first angle formed therebetween;

a second supporting member having a second pinching part and a second securing part oriented in different directions to have a second angle formed therebetween, the second pinching part being urged against the first pinching part; and a securing member that secures the first securing part and the second securing part while pinching the layer thickness regulating blade between the first pinching part and the second pinching part.

2. The developing device according to claim 1, wherein the first angle is greater than the second angle.

3. The developing device according to claim 1, wherein the first securing part is formed with a first hole and the second securing part is formed with a second hole, the first hole and the second hole being in alignment with each other, and wherein the securing member comprises a screw for threading insertion into the first hole and the second hole.

4. The developing device according to claim 1, wherein the first securing part is formed with a plurality of first holes at equi-pitch and the second securing part is formed with a plurality of second holes at equi-pitch, the plurality of first holes and the plurality of second holes being in alignment with one another on a hole-to-hole basis, and wherein the securing member comprises a plurality of screws for threading insertion into the plurality of first holes and the plurality of second holes.

5. The developing device according to claim 3, wherein the first securing part is further formed with a boss to surround the first hole, the boss having a shape and a size to be inserted into the second hole.

6. The developing device according to claim 5, wherein the boss is inserted into the second hole to have the first securing part and the second securing part secured and to position the first pinching part and the second pinching part such that the layer thickness regulating blade is pinched therebetween.

7. The developing device according to claim 1, wherein the first supporting member has a first thickness and the second supporting member has a second thickness smaller than the first thickness.

8. The developing device according to claim 5, wherein the boss has a height and the second supporting member has a second thickness that is larger than the height.

* * * * *